United States Patent [19]

Lasker et al.

[11] Patent Number: 4,760,507

[45] Date of Patent: Jul. 26, 1988

[54] ELECTRICAL LIGHTING FIXTURE HAVING VARIABLE DISTRIBUTION CHARACTERISTICS

[75] Inventors: Martin L. Lasker, Edison, N.J.; Joel S. Cohen, Oakland, Calif.

[73] Assignee: Prescolite, Inc., San Leandro, Calif.

[21] Appl. No.: 70,197

[22] Filed: Jul. 6, 1987

Related U.S. Application Data

[63] Continuation of Ser. No. 837,733, Mar. 10, 1986, abandoned.

[51] Int. Cl.[4] ..... F21S 1/02

[52] U.S. Cl. ..... 362/239; 362/250; 362/275; 362/419

[58] Field of Search ..... 362/238, 239, 250, 275, 362/287, 372, 368, 419

[56] References Cited

U.S. PATENT DOCUMENTS

| | | | |
|---|---|---|---|
| 1,623,699 | 4/1927 | Price | 362/419 |
| 2,649,535 | 8/1953 | Feder | 362/275 |
| 2,758,196 | 8/1956 | Greppin | 362/239 |
| 4,306,279 | 12/1981 | Cohen | 362/365 |
| 4,363,084 | 12/1982 | Dimiceli | 362/250 |
| 4,392,183 | 7/1983 | Östlund et al. | 362/239 |
| 4,414,617 | 11/1983 | Galindo | 362/250 |

*Primary Examiner*—Andrew M. Dolinar
*Attorney, Agent, or Firm*—Bielen & Peterson

[57] ABSTRACT

A lighting fixture utilizing an electrical lamp connected to an electrical power source. The fixture entails a base member which is rotatably mounted to an object. A body is also provided which supports the electrical lamp. The body includes a first end portion and a second end portion, the first end portion of which rotates in relation to the body. A swivel member supported by the body rotates the lamp which is held to the swivel member.

12 Claims, 5 Drawing Sheets

FIG-4
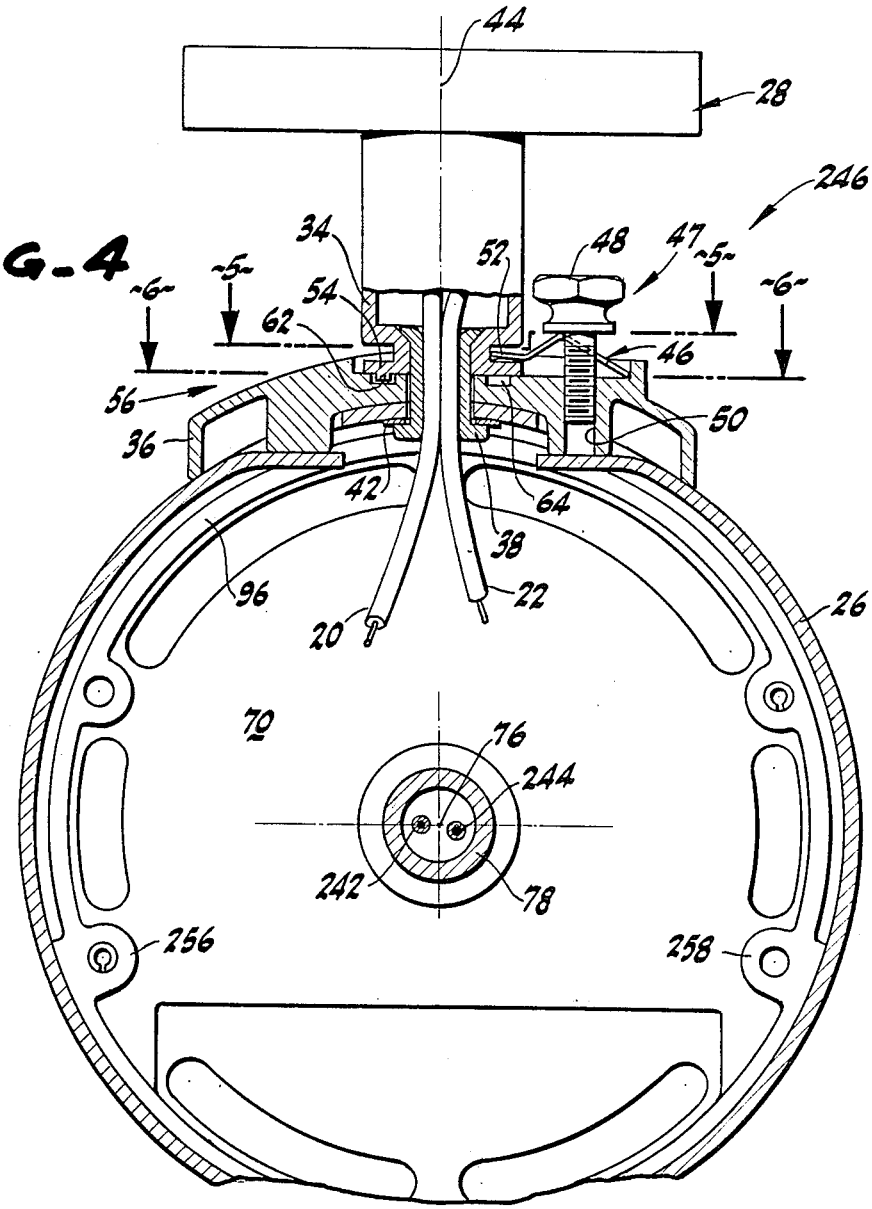
FIG-5
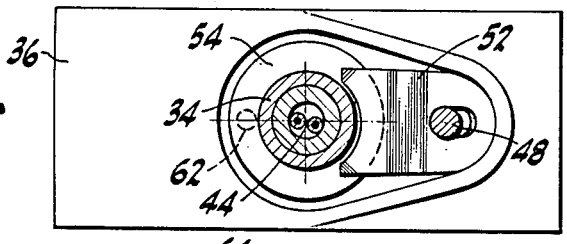
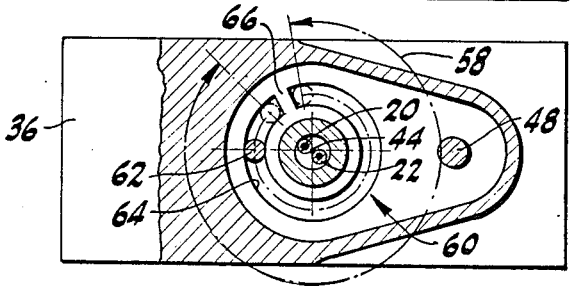
FIG-6

FIG-7
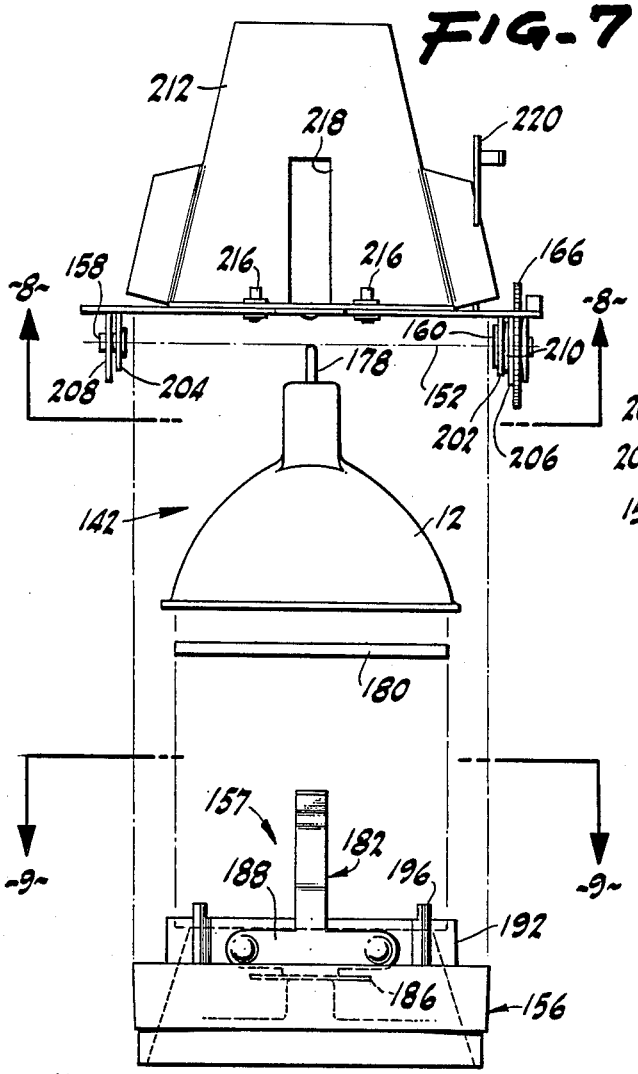
FIG-8
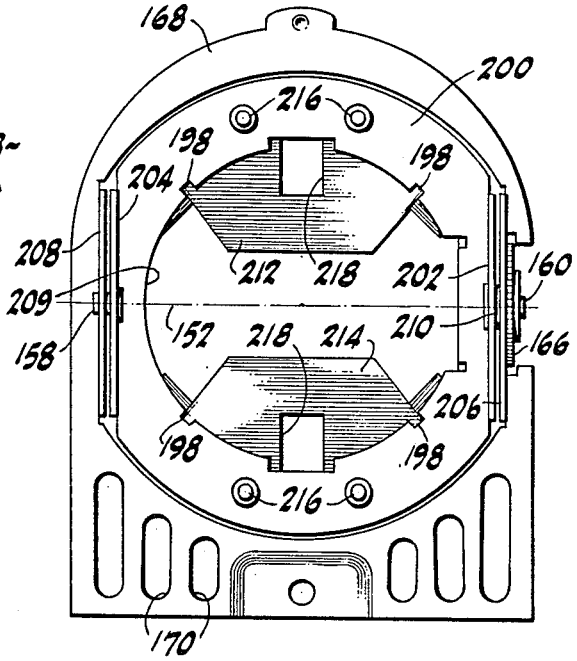
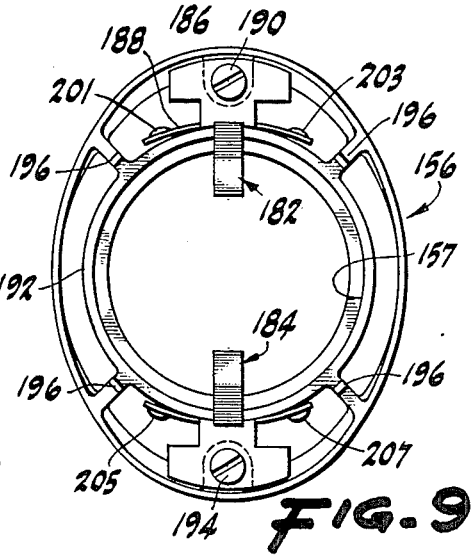
FIG-9
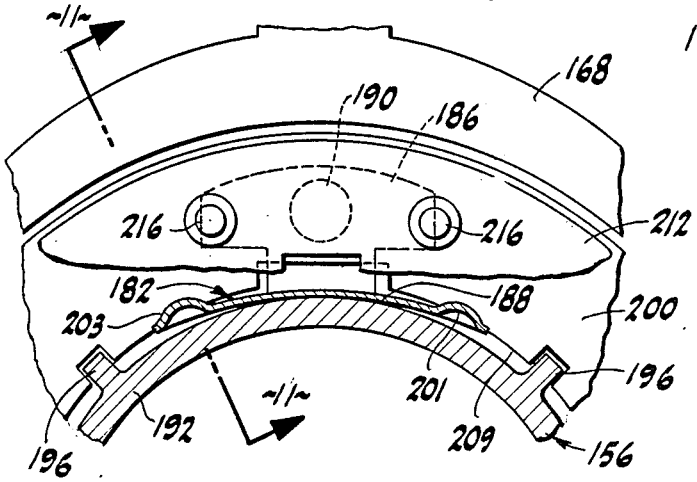
FIG-10
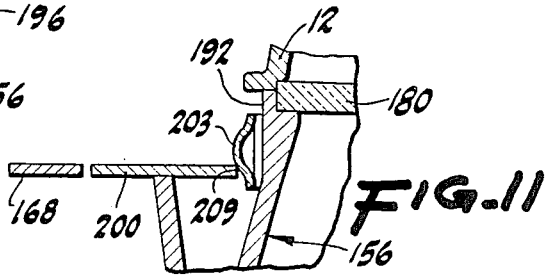
FIG-11

ELECTRICAL LIGHTING FIXTURE HAVING VARIABLE DISTRIBUTION CHARACTERISTICS

This is a continuation of application Ser. No. 837,733 filed Mar. 10, 1986, now abandoned.

BACKGROUND OF THE INVENTION

The present invention relates to a novel electrical lighting fixture which may be adjusted in multiple directions to distribute light emanating from a lamp held in the lighting fixture.

Lighting fixtures have been devised which are adjustable in that the electrical lamp lies on a rotatable bar or yoke which is rotatable on two orthogonal axes. For example, U.S. Pat. No. 4,306,279 depicts a recessed lighting fixture of this type. Although useful, such lamps generally require structural support for portions of the mechanism permitting rotation of the lamp and possess a restricted cone of light distribution.

Another variation on the adjustable type lighting fixture may be found in a surface mounted lamp distributed under the trademark "Accent One" by Gardco Lighting of San Leandro, Calif. The Gardco lighting fixture increases the cone of light distribution by utilizing a rotational adjustment about an axis combined with a beam tilt adjustment of the lamp within the fixture. Track lighting fixtures have similar restrictions.

A lighting fixture that is adjustable to provide a hemispherical or greater than hemispherical range of distribution as well as being applicable to a track light fixture would be a great advance in the art of lighting.

SUMMARY OF THE INVENTION

In accordance with the present invention a novel lighting fixture having an increased distribution ability and being adaptable to a track lighting system is provided.

The lighting fixture of the present invention may be mounted relative to an object such as, but not limited to, a lighting track. The lighting fixture utilizes an electrical lamp and means for electrically connecting the lighting fixture to source of electrical power.

The subject fixture includes a base member which has means for rotatably mounting the base member to the object about a first axis. In the case where the object is a lighting track, the base member would slide along the lighting track as desired. One side of the base member connects to a lamp supporting body having a first end portion and a second end portion. Means is also provided for rotating the lamp supporting body about second axis in relation to the base member. The lamp supporting body rotating means locates at the first end portion of the lamp supporting body. Rotation of the lamp supporting body, of course, rotates the electrical lamp in relation to the second axis. Another lamp supporting body may be attached to the opposite side the base member and be axially aligned with the first lamp supporting body connected to the base member.

Each lamp supporting body possesses a swivel member which mechanically links the electrical lamp to the lamp supporting body. Each swivel member rotates about third and fourth axes, respectively, which may be parallel to one another. Thus, each lamp mounted in the lamp supporting bodies may revolve about the first axis of the base member and rotate about the second and third and the second and fourth axes, respectively. Rotation about the second axis may be approximately 180 degrees or more thus, light may be distributed within a hemispherical envelope. In the case where two lamp supporting bodies are utilized in conjunction with the base member, separate items may be precisely illuminated from the same fixture within a tremendous range of location on a surface remote from the object to which the lighting fixture is mounted.

Each lamp supporting body may include a chamber located between the first and second end portions. A swivel member may positions in the vicinity of the chamber such that the electrical lamp at least partially occupies the chamber. The chamber may include a reflector and also serve to conceal the lamp portion of the found therein. A partition may at least partially enclose a portion of each chamber. Any heat build-up in the chamber may be vented therefrom by the use of venting means.

Each swivel member may include a plate having an opening through the same and a lamp seat which occupies an opening through the plate. The lamp seat may be pivotally attached to the plate and may include means for removably holding the lamp to the same. Further, lamp seat may be partially disassembled from its position and may be locked in a pivotal position relative to the plate.

The means for rotating the swivel member, the lamp supporting body, and the base member may also be coupled with locking means for fixing any one of these elements in a certain position.

It may be apparent that a novel and useful electrical lighting fixture has been described.

It is therefore an object of the present invention to provide an electrical lighting fixture for a plurality of lamps which are movable about a multiplicity of axes to provide light distribution throughout an extremely large area.

It is another object of the present invention to provide a lighting fixture which may precisely and independently distribute light on a plurality of subjects without appreciably changing the outward configuration of the lighting fixture itself.

It is yet another object of the present invention to provide a lighting fixture which reduces the total number of lighting fixtures which was needed in the prior art to illuminate a multiplicity of subjects in a space.

A further object of the present invention is to provide a lighting fixture which has an outward ornamental configuration which is alignable with a like lighting fixture without affecting the ability of the lighting fixtures to illuminate subjects scattered throughout an area.

Another object of the present invention is to provide a lighting fixture which is easily adaptable to a track lighting system.

The invention possesses other objects and advantages especially as concerns particular characteristics and features thereof which will become apparent as the specification continues.

BRIEF DESCRIPTION OF THE DRAWINGS

FIG. 4 is a sectional view taken along line 4—4 of FIG. 1.

FIG. 5 is a sectional view taken along line 5—5 of FIG. 4.

FIG. 6 is a sectional view taken along line 6—6 of FIG. 4.

FIG. 7 is an exploded view of the lamp supporting mechanism found in the lamp supporting body.

FIG. 8 is a bottom plan view of a portion of FIG. 7 taken along line 8—8 of FIG. 7.

FIG. 9 is a top plan view of a portion of FIG. 7 taken along 9—9 of FIG. 7.

FIG. 10 is an enlarged sectional view taken along 10—10 of FIG. 1.

FIG. 11 is a sectional view taken along line 11—11 of FIG. 10.

Figure 1:
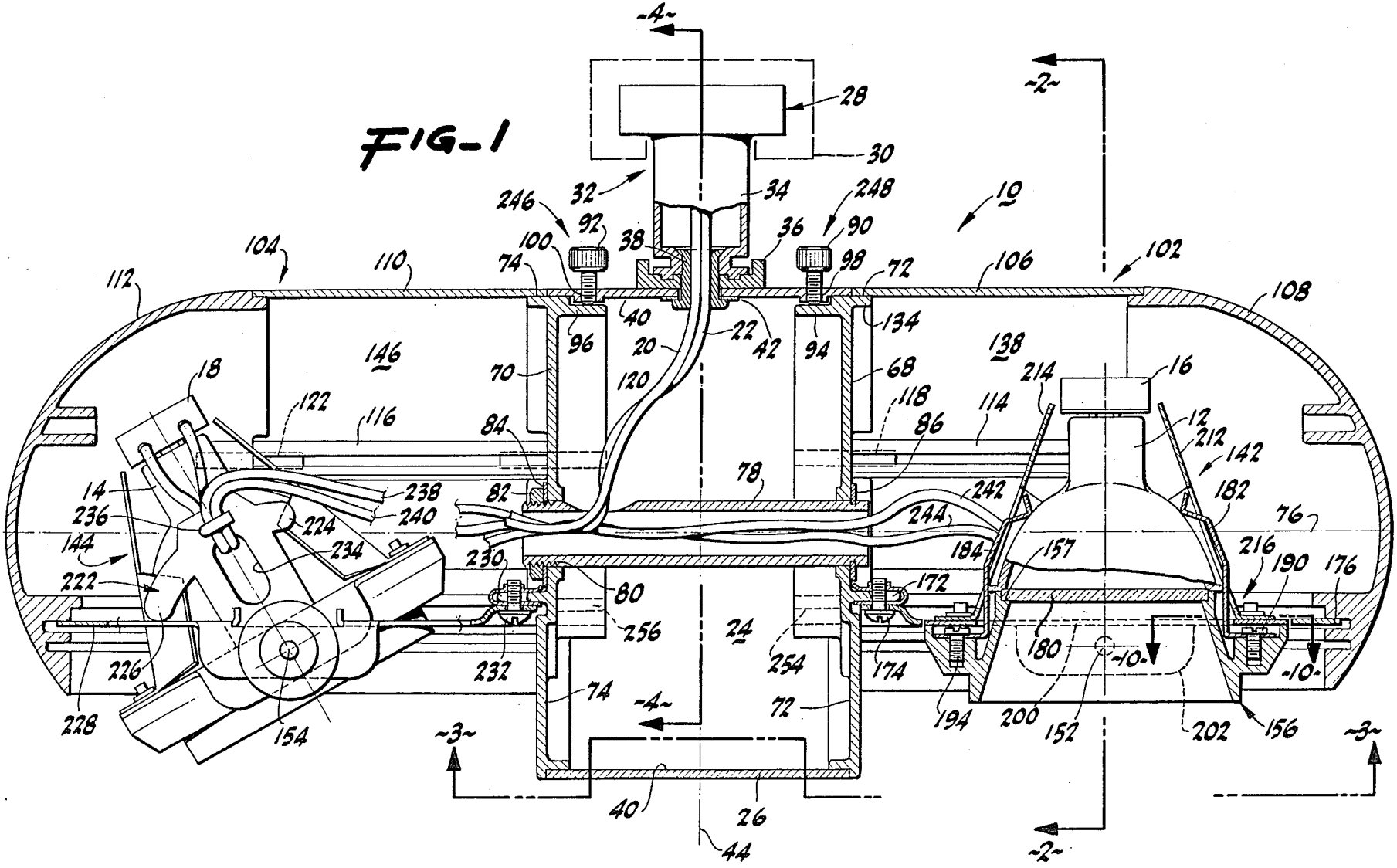
FIG. 1 is a vertical sectional view on the long axis of the lighting fixture of the present invention.

For a better understanding of the invention reference is made to the following detailed description of the preferred embodiments of the invention which should be referenced to the hereinabove described drawings.

DESCRIPTION OF THE PREFERRED EMBODIMENTS

The invention as a whole is shown in the drawings by reference character 10. The lighting fixture 10 includes as one of its components lamps 12 and 14, FIG. 1, which are commercially available. For example an M.R.-16 lamp manufactured by the General Electric Co. of Schenectady, N.Y. would suit this purpose. Lamps 12 and 14 plug into the sockets 16 and 18 respectively. In turn, electrical conductors 20 and 22 feed sockets 14 and 16 via conventional electrical components such as a transformer and the like (not shown). Such electrical components would be found in chamber 24 within base member 26. Adapter 28 slidingly engages a light track 30 of a track lighting system of conventional configuration. Although light fixture 10 has been illustrated in the drawings as a track lighting fixture, light fixture 10 may be attached to other objects such as walls, lamp bases, and the like. Thus, adapter 28 and electrical track 30 constitute means 32 for electrically connecting light fixture 10 to a source of electrical power. By way of example, means 32 may be a track Model #TS2 and complimentary adapter manufactured by Prescolite Inc. of San Leandro, Calif.

Base member 26 may be formed of cast aluminum, plastic, or any such suitable materials normally used with lighting fixtures. Adapter 28 includes an end portion 34 which is rotatable in relation to adapter base 36. Adapter base 36 fixes to base member 26, by set screws 39 and 41, FIG. 3. Flarebushing 38 extends to the interior of base member 26 and is separated from the inner wall 40 thereof by flat spring washer 42. Thus, bushing 38 rotates with end portion 34 of adapter 38. Base member 26 is, therefore, rotatable around axis 44. Clamp 46 FIG. 4 serves as a lock and/or control for such rotation when threaded thumb screw 48 is turned within threaded opening 50 of member 36. Tongue 52 of clamp 46 engages the upper surface of flange 54 to lock and/or control the ease of rotation of base member 26 about axis 44. As such, end portion 34, bushing 38, and washer 42 constitute means 56 for rotatably mounting base member 26 to an object such as track adapter 28 according to directional arrow, 58, FIG. 6. Clamp 46, and thumb screw 48 may constitute means 47 for locking and/or controlling the rotation of base member 26 about axis 44.

FIGS. 5 and 6 also depict stop mechanism 60 which includes a protuberance 62 which extends from flange 54 of end portion 34. Protuberance 62 rides in channel 64 of adapter base 36 and contacts either side of wall 66. The positions of protuberance 62 adjacent wall 66 are shown in phantom in FIG. 6. Thus, base 26 rotates almost 360° around axis 44.

Returning to FIG. 1, it may be noted that base member 26 engages rotation plates 68 and 70. More specifically, outer surfaces 72 and 74 of rotation plates 68 and 70 slide along inner wall of base member 26. Rotation plates 68 and 70 turn around axis 76. Coupling tube 78 holds rotation plate 68 and 70 in mated engagement. In this regard, threaded end 80 of coupling tube 78 threadingly engages nut 82 having a washer 84. Retaining ring 86 fits in a groove 88 on the opposite end of coupling tube 78. Thumbs screws 90 and 92 ride on flanges 94 and 96 and threadingly engage base member 26 through openings 98 and 100. Thus, tightening thumb screws 90 and 92 will lock and/or control the ease of rotation of rotation plates 68 and 70 about axis 76.

Lamp supporting bodies 102 and 104 connect to rotation plates 68 and 70 respectively. Lamp supporting body 102 includes a first end portion 106 and a second end portion 108, which may be termed an end cap. Likewise, lamp supporting body 104 is formed with a first end portion 110 and a second end portion or end cap 112. Closed channels 114 and 116 are cast or molded into end portions 106 and 110 of lamp supporting bodies 102 and 104 respectively. Pins 118 (FIG. 1) and 119 (FIG. 2) extend into slotted channel 114 to connect rotation plate 68, end portion 106, and end cap 108 as a unit. In essence, pins 120 and 122 perform the same function to form a unit consisting of rotation plate 70, first end portion 110, and end cap 112.

Figure 2:
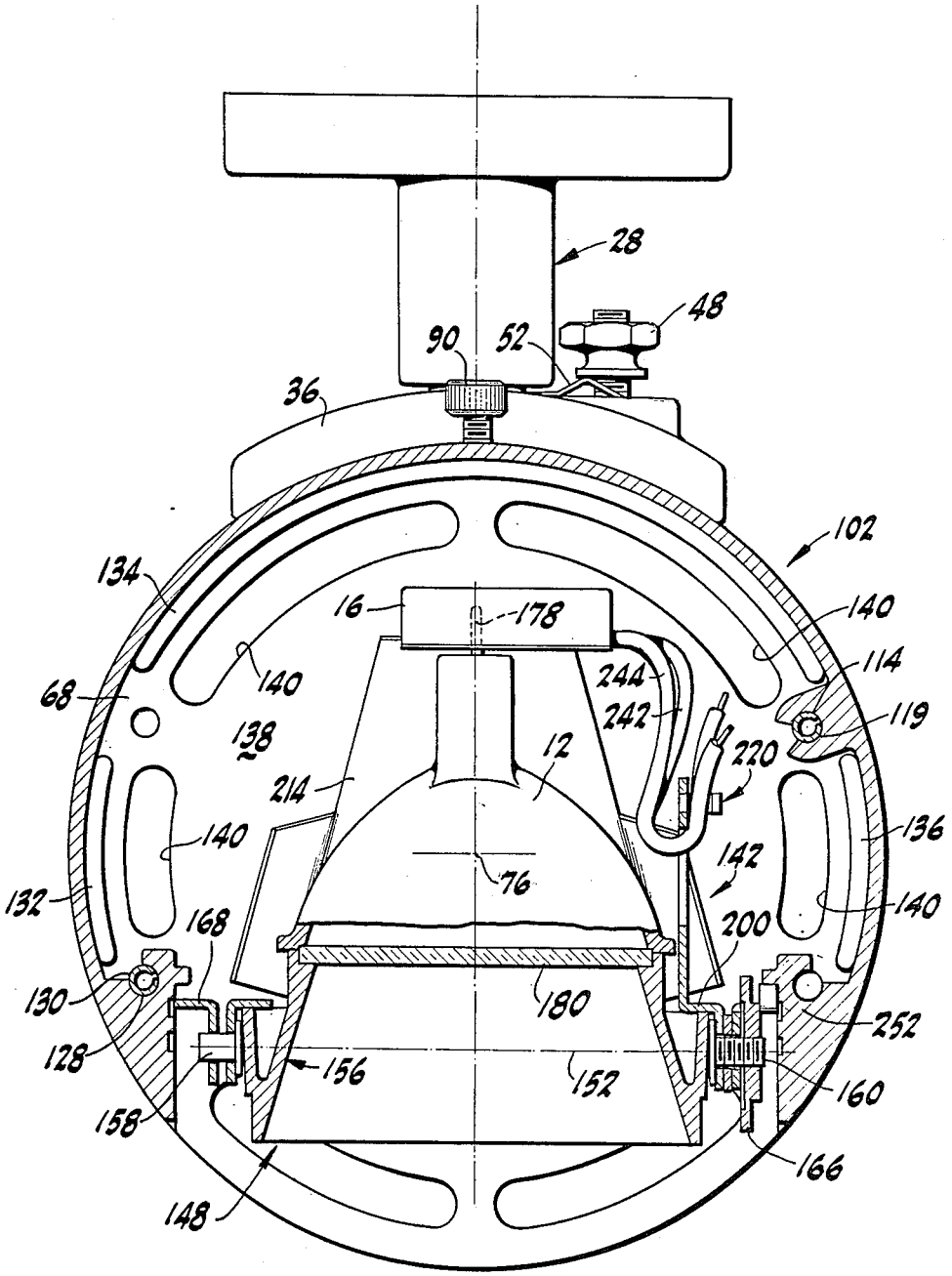
FIG. 2 is a sectional view along line 2—2 of FIG. 1.

Turning to FIG. 2, lamp support body 102 is shown in sectional detail. However, it should be understood that lamp support body 104 would be the mirror image of lamp support body 102. Thus, the description hereinafter pertaining to the elements found within lamp support body 102 would also apply to lamp support body 104. Channel 128 and pin 130 further strengthen the bond between plate 68 and lamp supporting body 102. Flanges 132, 134, and 136 of rotation plate 68 overlap the inner wall of first end portion 106 of lamp supporting body 102.

Lamp supporting body 102 includes a chamber 138. Plurality of openings 140 through rotation plate 68 vent chamber 24 of base member 26 to chamber 138. Also, within chamber 138 is a lamp support unit 142 which is similar to lamp support unit 144 within chamber 104 of lamp support body 146. Lamp support unit member 142 includes a swivel member 148 which mechanically holds the lamp 12. Swivel member 148 includes means 150 for rotating lamp 12 about axis 152. In a similar manner, lamp 14 rotates about axis 154, FIG. 1. Axes 152 and 154 are parallel to each other in the embodiments shown in the drawings. It should also be noted that the axis of rotation of lamp supporting body 102 is coincident with the axis of rotation of lamp of supporting body 104, i.e. axis 76.

Figure 3:
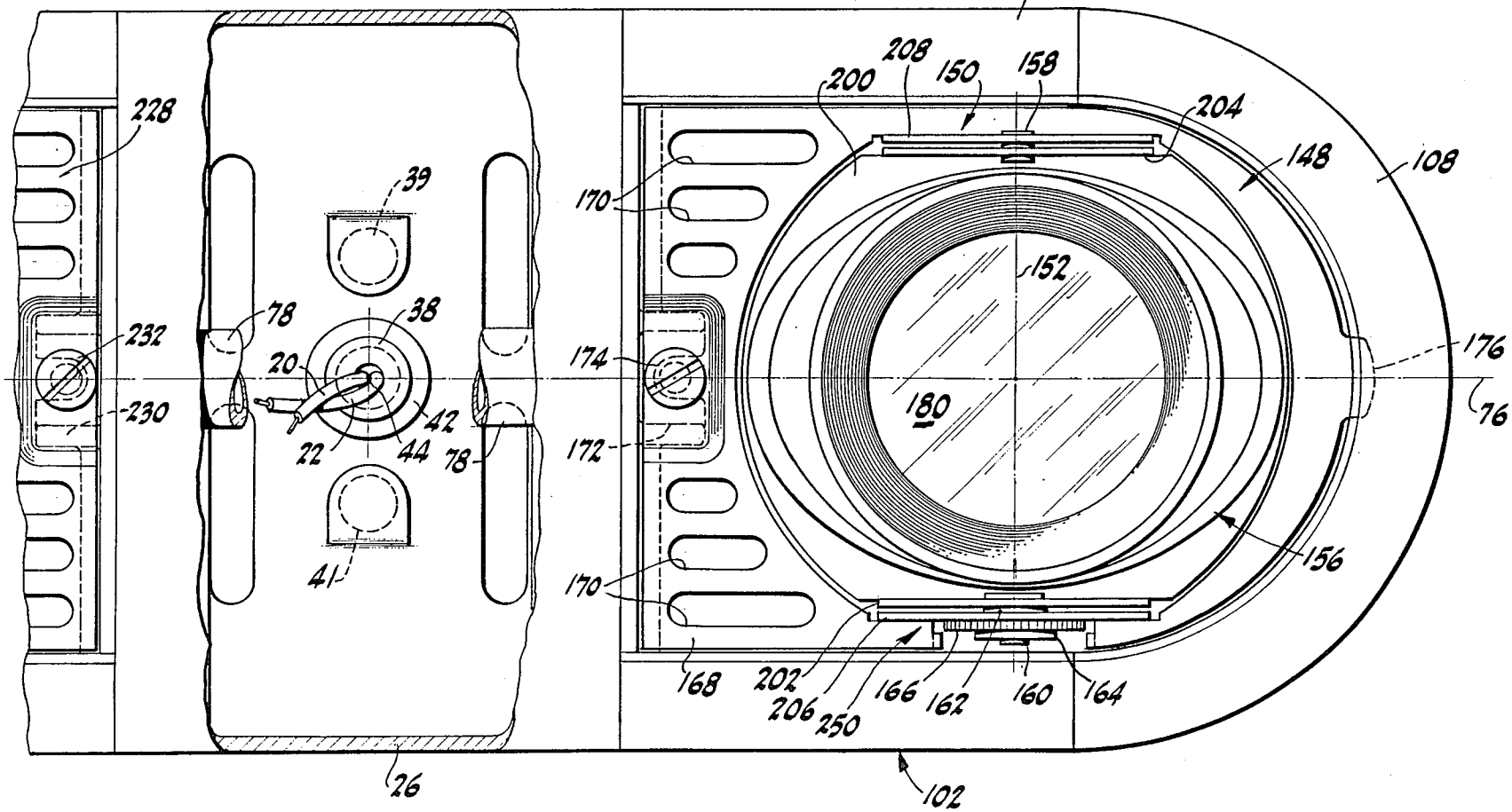
FIG. 3 is a broken bottom plan view of the lighting fixture as depicted along line 3—3 of FIG. 1.

With reference to FIGS. 2 and 3 it may be discerned that swivel member 148 includes a baffle cone 156 which swivels on pins 158 and 160 on axis 152. Washers 162 and 164, in combination with wheel 166, locks the rotational position of baffle cone 156, and lamp 12, about axis 152. Pins 158 and 160 extended to plate 168 which includes plurality of openings 170 for venting chamber 138 to the ambient air. Plate 168 is connected to tab 172 on rotation plate by the use of set screw 174. Tab 176 on plate 168 engages end cap 108 such that the mere removal of set screw 174 will free plate 168 and, consequently, the entire lamp support unit 142. Lamp 12 is easily replaced after such removal.

Looking at lamp support unit 142 more detail, reference is made to FIGS. 7–11. In FIG. 7, lamp 12 includes prongs 178 which engage socket 16. Lamp 12 is protected by a transparent lens 180. Lamp 12 and lens 180 are held in lamp seat 157 to the rear of baffle cone 156 by spring legs 182 and 184. With reference to FIG. 10, it may be apparent that spring leg 182 extends from a plate 186 having a slightly curved member 188. Set screw 190 holds plate 186, and spring leg 182 to baffle cone 156. Spring leg 184 is held to cone 156 in a similar manner. Baffle cone 156 is constructed with a rim portion 192 which combined with spring legs 182 and 184, FIGS. 10 & 11, serves to support lamps 180. With reference to FIG. 9, set screw 194 is shown to hold spring leg 184 to baffle cone 156.

Returning to FIG. 7, it may be apparent that baffle cone 156 includes a plurality of risers 196 (4 depicted in FIG. 9). Guides 196 fit into plurality of slots 198 of movable plate 200. Protuberances 201, 203, 205 and 207 frictionally engage inside surface 209 of movable plate 200, FIG. 11. Thus, plate 200 is friction fitted to baffle cone 156 and may be considered parts of lamp seat 157. Movable plate 200 includes a pair of ears 202 and 204 which serve as a base for pins 158 and 160. Plate 168 also include ears 206 and 208 which compliment ears 202 and 204 in that pins 158 and 160 gain support therefrom. Washer 210 separates ears 202 and 206 on the axis 152 of pin 160.

Light shields 212 and 214, FIGS. 1,2, and 7 which are held to movable plate 200 by plurality of rivets 216. Light shields 214 and 216 may be constructed of any heat insulative material such as paper, plastic, and the like. Each light shield includes a slot, such as slot 218 of light shield 212, to accommodate the movement of spring legs 182 and 184 away from lamp 12.

Movable plate 200 includes a stop leg 220 which extends outwardly therefrom. Returning to FIG. 1 it may be seen that stop leg 222 associated with lamp supported unit 144 is depicted and is substantially identical to stop leg 220 associated with lamp supported unit 144. As depicted in FIG. 1, stop leg 222 includes arcuate extensions 224 and 226 which contact plate 228, analogous to plate 168, FIGS. 1 and 3. Plate 228 is held to tab 230 by set screw 232. Stop leg 222 includes a slot 234 and a clip 236 for guiding and holding electrical conductors 238 and 240. Stop leg 220 of lamp support with electrical conductors 242 and 244. Of course, electrical conductors 238, 240, 242 and 244 electrically link lamps 12 and 14 with a source of electrical power. Electrical conductors 20 and 22 are spliced to electrical conductors 238, 240, 242, and 244 (not shown) in a conventional manner.

Lamps 12 and 14 may be directed in a variety of positions and fixed in those positions. As heretofor described, means 47 will stop the rotation of base member 26 in relation to adapter 28. Means 246 and 248 actuated by thumb screws 90 and 92, will control and/or lock the rotation of lamp supporting bodies 102 and 104 about axis 76 in relation to base member 26. As heretofore noted, bodies 102 and 104 are coaxial. Also, swivel means 150 for rotating swivel member 148, specifically plate 200 in relation to plate 168 in conjunction with lamp 12, includes means 250 for locking the position of lamp 12 about axis 152. Lamp 14 includes a similar means for locking the rotation of lamp 14 about axis 154. Means 250 is activated by turning wheel 166. Ears 202 and 206, and ears 204 and 208, respectively, are then fixed in relation to one another by the tightening of wheel 166.

In operation, the user would attach adapter 28 to an object, such as a ceiling or a wall, and electrically to a source of electrical power. Adapter 28, as heretofore noted, may connect an electrical lighting track 30. Base member 26 may be rotated 360° about axis 44 and controlled or locked into a position utilizing thumb screw 48. Lamp supporting bodies 102 and 104 may be rotated about axis 78 approximately 180°, 90° clockwise and counterclockwise, about axis 76 to the positions shown in FIGS. 1 and 2. It should be noted that channels 128 and 252, FIG. 2, align with bosses 254, FIG. 1, and one not shown which extend from flange 94 to prevent greater than 180° rotation of rotation plate 68. Rotation plate 70 possesses the same structure in this regard having bossess 256 and 258 which extend from flange 96. Also, lamps 12 and 14 may be rotated about axes 152 and 154, respectively. With reference to FIG. 1, it may be seen that lamp 14 has been turned inwardly toward base member 26 the maximum degree of rotation, about 30°. Lamps 12 and 14 may be turned outwardly in relation to base member 26 approximately 46°. Thus, lamps 12 and 14 may be swung across a lateral are of 76° in relation to axes 152 and 154. Consequently, lamps 12 and 14 may be individually focused on two subjects independently of one another all in all, lighting fixture 10 may provide light to a subject at very large number of positions within a space.

While in the foregoing embodiments of the present invention have been set forth in considerable detail for the purposes of making a compete disclosure of the invention, it may be apparent to those of skill in the art that numerous changes may be made in such detail without departing from the spirit and principles of the invention.

What is claimed is:

1. A lighting fixture being mounted relative to an object, the lighting fixture having first and second electrical lamps and including means for electrically connecting the lighting fixture to a source of electrical power comprising:

a. a base member;

b. means for rotatably mounting said base member to the object for rotation about a first axis;

c. a first electrical, lamp, supporting body being contiguous with said base member, including an end portion, and including a chamber, the first electrical lamp at least partially occupying said first electrical lamp supporting body chamber and projecting light directly from said first lamp supporting body;

d. a second, electrical, lamp, supporting body being contiguous with said base member, including an end portion, and including a chamber the second electrical lamp at least partially occupying said second lamp supporting body chamber and projecting light directly from said second lamp supporting body and first and second electrical lamp supporting bodies lying on opposite sides of said base member;

e. means for rotating said first electrical lamp supporting body and the first electrical lamp about a second axis relative to said base member;

f. means for rotating said second electrical lamps supporting body and the second electrical lamp about a third axis relative to said base member;

g. a first swivel member being connected to said first lamp supporting body, said first swivel member including means for mechanically linking the first electrical lamp thereto, said first swivel member including means for rotation of the first electrical lamp about a fourth axis; and h. a second swivel member being connected to said second lamp supporting body, said second swivel member including means for mechanically linking the second electrical lamp thereto, said second swivel member including means for rotation of the second electrical lamp about a fifth axis; said rotation of said base member causing rotation of the first and second electrical lamps; said first and second swivel members each including a partition at least partially enclosing said first and second lamp supporting body chambers, respectively, and further including means for venting said at least partially enclosed chambers.

2. The lighting fixture of claim 1 in which said means for rotation of the first electrical lamp about a fourth axis further comprises means for locking said first swivel member in a rotational position about said fourth axis.

3. The lighting fixture of claim 2 in which said means for rotating said first electrical lamp supporting body about said second axis further comprises means for locking said first electrical lamp supporting body in a rotational position about said second axis.

4. The lighting fixture of claim 1 in which said base member includes means for mechanically connecting said base and electrically connecting the lamp to a lighting track.

5. A lighting fixture being mounted relative to an object, the lighting fixture having first and second electrical lamps and including means for electrically connecting the lighting fixture to a source of electrical power comprising:

a. a base member;

b. means for rotatably mounting said base member to the object for rotation about a first axis;

c. a first electrical, lamp, supporting body being contiguous with said base member, including an end portion, and including a chamber, the first electrical lamp at least partially occupying said first electrical lamp supporting body chamber and projecting light directly from said first lamp supporting body;

d. a second electrical, lamp, supporting body being contiguous with said base member, including an end portion, and including a chamber the second electrical lamp at least partially occupying said second lamp supporting body chamber and projecting light directly from said second lamp supporting body and first and second electrical lamp supporting bodies lying on opposite sides of said base member;

e. means for rotating said first electrical lamp supporting body and the first electrical lamp about a second axis relative to said base member;

f. means for rotating said second electrical lamps supporting body and the second electrical lamp about a third axis relative to said base member; said second axis and said third axis being coincident;

g. a first swivel member being connected to said first lamp supporting body, said first swivel member including means for mechanically linking the first electrical lamp thereto, said first swivel member including means for rotation of the first electrical lamp about a fourth axis; and h. a second swivel member being connected to said second lamp supporting body, said second swivel member including means for mechanically linking the second electrical lamp thereto, said second swivel member including means for rotation of the second electrical lamp about a fifth axis; said rotation of said base member causing rotation of the first and second electrical lamps.

6. The lighting fixture of claim 5 in which said first and second swivel members each include a partition at least partially enclosing said first and second lamp supporting body chambers, respectively, and further includes means for venting said at least partially enclosed chambers.

7. The lighting fixture of claim 6 in which said means for rotation of the first electrical lamp about a fifth axis further comprises means for locking said second swivel member in a rotational position about said fifth axis.

8. The lighting fixture of claim 7 in which said means for rotation the second electrical lamp supporting body about said third axis further comprises means for locking said second electrical lamp supporting body in a rotational position about said third axis.

9. The lighting fixture of claim 5 in which said base member includes means for mechanically connecting said base and electrically connecting the lamp to a lighting track.

10. A lighting fixture being mounted relative to an object, the lighting fixture having first and second electrical lamps and including means for electrically connecting the lighting fixture to a source of electrical power comprising:

a. a base member;

b. means for rotatably mounting said base member to the object for rotation about a first axis;

c. a first electrical, lamp, supporting body being contiguous with said base member, including an end portion, and including a chamber, the first electrical lamp at least partially occupying said first electrical lamp supporting body chamber and projecting light directly from said first lamp supporting body;

d. a second electrical, lamp, supporting body being contiguous with said base member, including an end portion, and including a chamber the second electrical lamp at least partially occupying said second lamp supporting body chamber and projecting light directly from said second lamp supporting body and first and second electrical lamp supporting bodies lying on opposite sides of said base member;

e. means for rotating said first electrical lamps supporting body and the first electrical lamp about a second axis relative to said base member;

f. means for rotating said second electrical lamps supporting body and the second electrical lamp about a third axis relative to said base member;

g. a first swivel member being connected to said first lamp supporting body, said first swivel member including means for mechanically linking the first electrical lamp thereto, said first swivel member including means for rotation of the first electrical lamp about a fourth axis;

h. a second swivel member being connected to said second lamp supporting body, said second swivel member including means for mechanically linking the second electrical lamp thereto, said second swivel member including means for rotation of the second electrical lamp about a fifth axis; said rotation of said base member causing rotation of the first and second electrical lamps, said first and second swivel members each including:

a plate having an opening therethrough;

a lamp seat, said lamp seat occupying a portion of said opening through said plate and being pivotally attached to said plate, said lamp seat further including means for removably holding the electrical lamp thereto; and means for removably fastening said plate to said lamp supporting body.

11. The lighting fixture of claim 10 which additionally comprises means for locking said lamp seat in a pivotal position relative to said plate.

12. The lighting fixture of claim 10 in which said base member includes means for mechanically connecting said base and electrically connecting the lamp to a lighting track.

* * * * *